US006766790B2

(12) United States Patent
Grass et al.

(10) Patent No.: US 6,766,790 B2
(45) Date of Patent: Jul. 27, 2004

(54) METHOD FOR WARMING-UP AN INTERNAL COMBUSTION ENGINE

(75) Inventors: Gerd Grass, Schwieberdingen (DE); Ruediger Weiss, Moetzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/168,564

(22) PCT Filed: Dec. 1, 2000

(86) PCT No.: PCT/DE00/04276

§ 371 (c)(1),
(2), (4) Date: Sep. 3, 2002

(87) PCT Pub. No.: WO01/50001

PCT Pub. Date: Jul. 12, 2001

(65) Prior Publication Data

US 2003/0056774 A1 Mar. 27, 2003

(30) Foreign Application Priority Data

Dec. 31, 1999 (DE) ..... 199 63 931

(51) Int. Cl.[7] ..... F02M 51/00; F02D 41/06
(52) U.S. Cl. ..... 123/491; 701/113
(58) Field of Search ..... 123/491, 436, 123/480, 295, 435, 443; 701/103, 104, 113

(56) References Cited

U.S. PATENT DOCUMENTS 4,440,136 A 4/1984 Denz et al.
4,543,937 A * 10/1985 Amano et al. ..... 123/491
4,711,217 A 12/1987 Kano et al.
5,441,030 A * 8/1995 Satsukawa ..... 123/491
5,471,836 A * 12/1995 Takeshima et al. ..... 60/297
5,564,406 A 10/1996 Klein
5,577,486 A * 11/1996 Harima et al. ..... 123/674
6,141,960 A * 11/2000 Takami et al. ..... 60/286
6,266,957 B1 * 7/2001 Nozawa et al. ..... 60/284
6,408,816 B1 * 6/2002 Tomita et al. ..... 123/295
6,634,167 B1 * 10/2003 Toshioka et al. ..... 60/284

FOREIGN PATENT DOCUMENTS

| | | | | |
|---|---|---|---|---|
| DE | 196 25 928 | | 1/1998 | |
| DE | 196 46 941 | | 5/1998 | |
| EP | 0 831 227 | | 3/1998 | |
| EP | 0 919 711 | | 6/1999 | |
| JP | 157246 | * | 7/1987 | ..... F02D/41/06 |
| JP | 154744 | * | 6/2000 | ..... F02D/41/04 |
| WO | WO 98 01659 | | 1/1998 | |

* cited by examiner

*Primary Examiner*—Hai Huynh
(74) *Attorney, Agent, or Firm*—Walter Ottesen

(57) ABSTRACT

An internal combustion engine, especially of a motor vehicle, is described wherein fuel can be injected into an intake manifold or into a combustion chamber during warm up. A control apparatus is provided for determining a warm-up factor (fWL) for increasing the injected fuel quantity below an operating temperature of the engine. With the control apparatus, the warm-up factor (fWL) is determined from a base factor (fG) and a load-dependent factor (fLA).

11 Claims, 2 Drawing Sheets

METHOD FOR WARMING-UP AN INTERNAL COMBUSTION ENGINE

FIELD OF THE INVENTION

The invention relates to a method for warming up an internal combustion engine, especially of a motor vehicle, wherein fuel is injected into an intake manifold or into a combustion chamber and wherein a warm-up factor for increasing the injected fuel quantity is determined below an operating temperature of the engine. The invention likewise relates to a corresponding internal combustion engine as well as to a corresponding control apparatus for such an engine.

BACKGROUND OF THE INVENTION

A method, internal combustion engine and a control apparatus of this kind are all known, for example, from a so-called intake manifold injection. There, fuel is injected into the intake manifold of the engine in homogeneous operation during the intake phase in order to then be inducted into the combustion chamber of the engine. Correspondingly, in a so-called direct-injection internal combustion engine, the fuel is injected into the combustion chamber directly during the induction phase or during the compression phase and is there combusted.

When warming up, in an engine, which is not operationally warm, an increased fuel quantity must be injected into the intake manifold or into the combustion chamber. This is carried out in a manner known per se with the aid of a warm-up factor which influences the quantity of fuel to be injected below the operating temperature of the engine.

The known determination of the warm-up factor is based on intake manifold injections and is therefore not flexibly useable. The known determination of the warm-up factor can only be used to a limited extent for direct-injection internal combustion engines.

SUMMARY OF THE INVENTION

The task of the invention is to provide a method for warming up an internal combustion engine with which a greater flexibility and especially a simplified application can be achieved for a simultaneously improved warm-up characteristic of the engine.

This task is solved in accordance with the invention in a method of the kind mentioned initially herein in that the warm-up factor is determined from a base factor and a load-dependent factor. The task is correspondingly solved in accordance with the invention in an internal combustion engine and in a control apparatus of the type mentioned initially herein.

With the separation of the base factor and the load-dependent factor in accordance with the invention, the last-mentioned factor can be determined for different modes of operation independently of the base factor. In this way, a simple use of the determination of the warm-up factor in accordance with the invention is possible for direct-injecting internal combustion engines.

Likewise, the base factor and the load-dependent factor can be applied independently of each other in accordance with the invention. The same applies also for the determination of the load-dependent factor in the different modes of operation of a direct-injecting internal combustion engine.

In the invention, it is especially not necessary to subsequently change the determination of the base factor in dependence upon a load being applied to the engine.

With the flexibility achieved in accordance with the invention, the invention is easily applicable to intake manifold injections. Here, the mutually independent application of the base factor and of the load-dependent factor is advantageously noted.

In advantageous embodiments of the invention, the load-dependent factor is determined in dependence upon an integrated air mass and/or an integrated fuel mass and/or a temperature of the engine and/or the load-dependent factor is determined in dependence upon a relative air charge and/or a relative fuel quantity and/or an actual or desired lambda and/or an actual or desired torque of the engine.

What is essential is that the load-dependent factor responds rapidly and flexibly to the load changes of the engine and/or to other changes of operating variables of the engine. From this results the advantage of a subjective good drivability of the engine even at low operating temperatures.

In a further advantageous embodiment of the invention, the base factor is determined in dependence upon the engine temperature. This defines an especially simple yet adequate possibility for determining the base factor.

In an advantageous configuration of the invention, the load-dependent factor and the base factor are additively logically coupled to each other. In this way, the factors, which are determined independently from each other in accordance with the invention, are again combined into the warm-up factor.

In an advantageous configuration of the invention, the load-dependent factor or the sum of the load-dependent factor and the base factor are weighted in dependence upon the rpm of the engine. The weighting therefore operates either on the load-dependent factor alone or on the sum of the load-dependent factor and the base factor. In this way, it is possible to carry out adaptations corresponding to the type of engine and with a view to the rpm weighting.

Of special significance is the realization of the method of the invention in the form of a control element which is provided for a control apparatus of an engine, especially of a motor vehicle. A program is stored on the control element which is capable of being run on a computer, especially on a microprocessor, and is suitable for executing the method according to the invention. In this case, the invention is realized by a program stored on the control element so that this control element, which is provided with the program, defines the invention in the same way as the method which the program can carry out. Especially an electric storage medium can be used as a control element, for example, a read-only-memory or a flash memory.

Further features, application possibilities and advantages of the invention will become apparent from the following description of embodiments of the invention which are illustrated in the drawing. All described or illustrated features define the subject matter of the invention by themselves or in any desired combination independently of their summary in the patent claims or their dependency as well as independently of their formulation or presentation in the description and/or in the drawing.

BRIEF DESCRIPTION OF THE DRAWINGS

The invention will now be described with respect to the drawings.

DESCRIPTION OF THE PREFERRED EMBODIMENTS OF THE INVENTION

Figure 1:
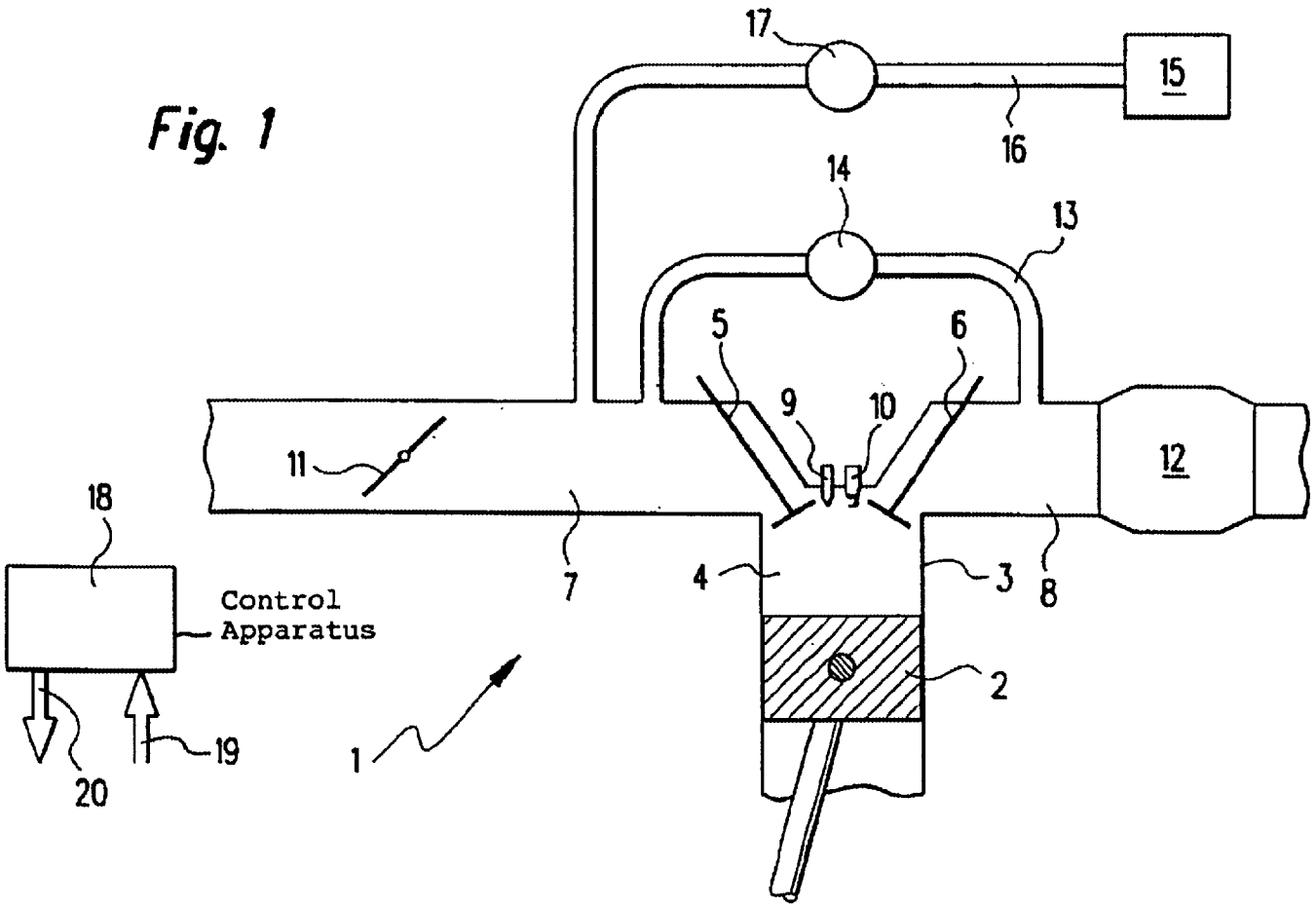
FIG. 1 shows a schematic block circuit diagram of an embodiment of an internal combustion engine according to the invention; and, FIG. 2 shows a schematic flowchart of a method of the invention for warming up the internal combustion engine of FIG. 1.

In FIG. 1, an internal combustion engine 1 of a motor vehicle is shown wherein a piston 2 is movable back and forth in a cylinder 3. The cylinder 3 is provided with a combustion chamber 4 which is, inter alia, delimited by the piston 2, an inlet valve 5 and an outlet valve 6. An intake manifold 7 is coupled to the inlet valve 5 and an exhaust-gas pipe 8 is coupled to the outlet valve 6.

An injection valve 9 and a spark plug 10 project into the combustion chamber 4 in the region of the inlet valve 5 and of the outlet valve 6. Fuel can be injected into the combustion chamber 4 via the injection valve 9. The fuel in the combustion chamber 4 can be ignited with the spark plug 10.

A rotatable throttle flap 11 is mounted in the intake manifold 7 and air can be supplied via the throttle flap to the intake manifold 7. The quantity of the supplied air is dependent upon the angular position of the throttle flap 11. A catalytic converter 12 is accommodated in the exhaust-gas pipe 8 and this catalytic converter serves to purify the exhaust gases arising because of the combustion of the fuel.

An exhaust-gas recirculation pipe 13 leads from the exhaust-gas pipe 8 back to the intake manifold 7. An exhaust-gas recirculation valve 14 is accommodated in the exhaust-gas recirculation pipe 13. With this valve 14, the quantity of the exhaust gas, which is recirculated into the intake manifold 7, can be adjusted. The exhaust-gas recirculation pipe 13 and the exhaust-gas recirculation valve 14 define a so-called exhaust-gas recirculation.

A tank-venting line 16 leads from a fuel tank 15 to the intake manifold 7. A tank-venting valve 17 is mounted in the tank-venting line 16 and, with this valve 17, the quantity of the fuel vapor, which is supplied from the fuel tank 15 to the intake manifold 7, can be adjusted. The tank-venting line 16 and the tank-venting valve 17 define a so-called tank venting.

The piston 2 is displaced by the combustion of the fuel in the combustion chamber 4 into a back and forth movement which is transmitted to a crankshaft (not shown) and applies a torque thereto.

Input signals 19 are applied to a control apparatus 18 and these signals define measured operating variables of the engine 1. For example, the control apparatus 18 is connected to an air-mass sensor, a lambda sensor, an rpm sensor and the like. Furthermore, the control apparatus 18 is connected to an accelerator pedal sensor which generates a signal which indicates the position of an accelerator pedal, which can be actuated by a driver, and therefore indicates the requested torque. The control apparatus 18 generates output signals 20 with which the performance of the engine 1 can be influenced via actuators or positioning devices. For example, the control apparatus 18 is connected to the injection valve 9, the spark plug 10 and the throttle flap 11 and the like and generates the signals required to drive the same.

The control apparatus 18 is, inter alia, provided to control (open loop and/or closed loop) the operating variables of the engine 1. For example, the fuel mass, which is injected by the injection valve 9 into the combustion chamber 4, is controlled (open loop and/or closed loop) by the control apparatus 18 especially with respect to a low fuel consumption and/or a low development of toxic substances. For this purpose, the control apparatus 18 is provided with a microprocessor on which a program is stored in a memory medium, especially in a flash memory, and this program is suited to execute the above-mentioned control (open loop and/or closed loop).

The internal combustion engine 1 of FIG. 1 can be operated in a plurality of operating modes. Accordingly, it is possible to operate the engine 1 in homogeneous operation, stratified operation, homogeneous lean operation, operation with double injection and the like.

In the homogeneous operation, the fuel is injected by the injection valve 9 directly into the combustion chamber 4 of the engine 1 during the induction phase. The fuel is thereby substantially swirled up to ignition so that an essentially homogeneous air/fuel mixture arises in the combustion chamber 4. The torque to be generated is adjusted by the control apparatus 18 essentially via the position of the throttle flap 11. In homogeneous operation, the operating variables of the engine 1 are so controlled (open loop and/or closed loop) that lambda is equal to one. The homogeneous operation is especially used at full load.

The homogeneous lean operation corresponds substantially to the homogeneous operation. However, the lambda is set to a value greater than 1.

In stratified operation, the fuel is injected by the injection valve 9 directly into the combustion chamber 4 of the engine 1 during the compression phase. In this way, no homogeneous mixture is present in the combustion chamber 4 with the ignition by the spark plug 10; instead, a fuel stratification is present. The throttle flap 11 can be completely opened except for requests, for example, of the exhaust-gas recirculation and/or of the tank venting and the engine 1 can thereby be operated dethrottled. The torque to be generated is, in stratified operation, substantially adjusted via the fuel mass. With the stratified operation, the engine 1 can be operated especially at idle and at part load.

There can be a back and forth switching or switchover between the above-mentioned operating modes of the engine 1.

If the engine is started at a temperature which is below an operating temperature thereof, then the engine 1 is started, for example, at a low outside temperature after a long standstill so that the fuel quantity, which is injected into the combustion chamber 4, is increased. In this way, not only an ignitable air/fuel mixture is made available in the combustion chamber 4 but those losses are also compensated which arise because of the input of fuel into the engine oil and/or because of the buildup of a wall film of fuel in the combustion chamber 4.

The engine 1 is warmed with each combustion so that the increase of the fuel quantity can be slowly reduced. If the operating temperature of the engine 1 is reached, then the injected fuel quantity is at least no longer increased.

The increase of the injected fuel quantity for a cold start of the engine 1 and its slow reduction is carried out with the aid of a warm-up factor fWL by the control apparatus 18. This warm-up factor fWL can still be coupled to a so-called after-start factor in order to thereafter influence the fuel quantity to be injected into the combustion chamber 4.

Figure 2:
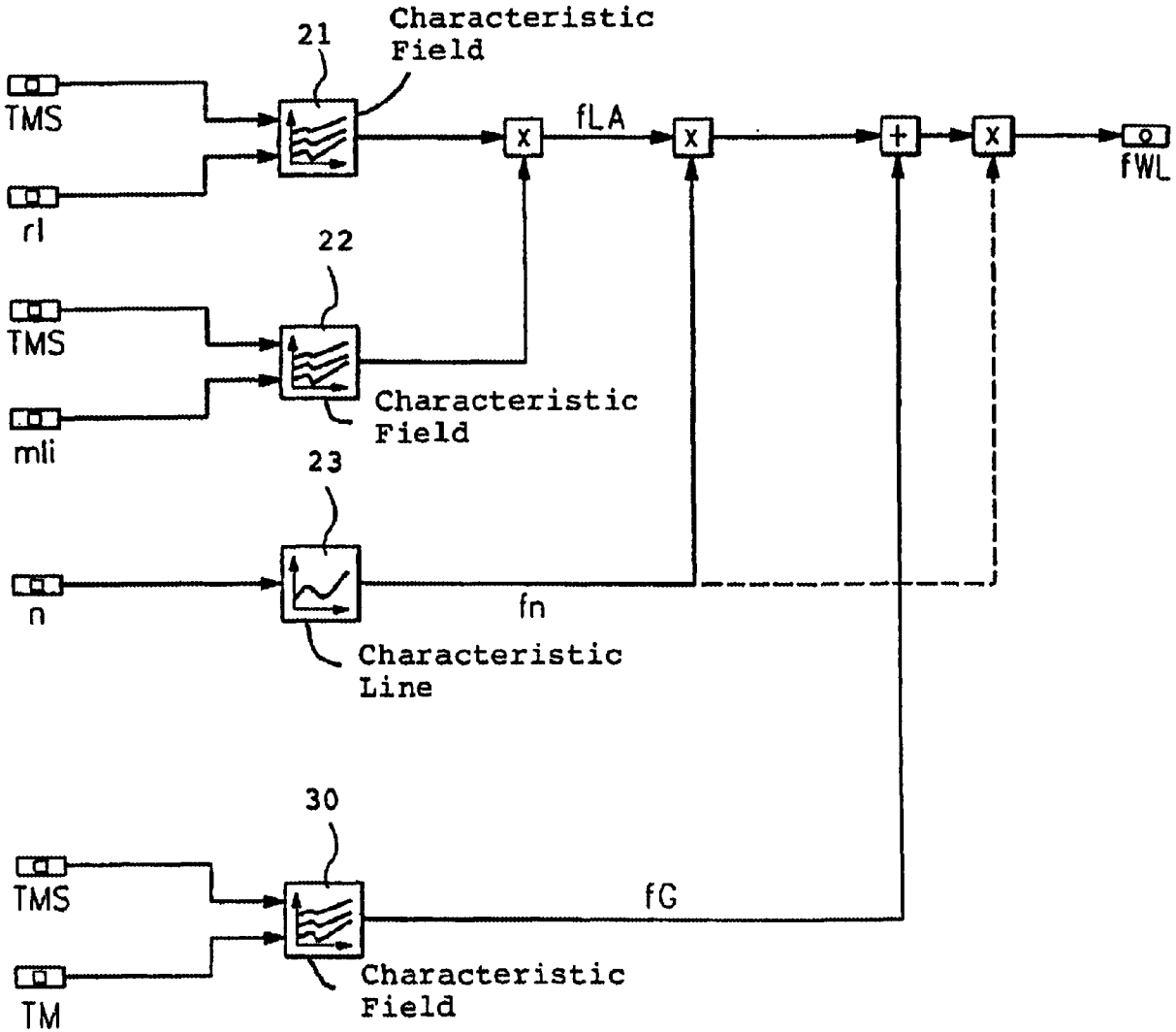

FIG. 2 shows the determination of the warm-up factor fWL. The warm-up factor fWL is determined from a base factor fG and a load-dependent factor fLA. Accordingly, a differentiation is made between a factor, which essentially only concerns idle (that is, the base factor fG) and a factor occurring only under load, namely, the load-dependent factor fLA. The base factor fG and the load-dependent factor fLA are therefore independent of each other and can be applied separately.

The base factor fG is determined by means of an idle characteristic field 30 to a which an engine start temperature TMS and an engine temperature TM are inputted. With the idle characteristic field 30, the base factor fG is so adjusted that a desired lambda control results for the idle or at a small applied load.

The engine start temperature TMS is the temperature of the engine 1 which the engine has when started. In this way, different start strategies are distinguished for a new start at a cold outside temperature and a restart at a warmer but not operationally warm engine. The engine temperature TM is the current engine temperature which increases with each combustion. When starting the engine 1, engine start temperature TMS and engine temperature TM are the same, at least for a short time.

The engine start temperature TMS is logically coupled to a relative air charge rl via a characteristic field 21 to determine the load-dependent factor fLA. The load dependency of the factor fLA is obtained with the relative air charge rl in the combustion chamber 4. It is understood that in lieu of the relative air charge rl, also a relative fuel quantity and/or an actual or desired lambda and/or an actual or desired torque or the like can be used.

Likewise, the engine start temperature TMS is coupled to an integrated air mass mli via a characteristic field 22. In this way, the value, which is obtained from the characteristic field 21, is reduced as the engine 1 becomes warmer. The integrated air mass mli is an index for the energy converted in the combustion chamber 4 and this energy, in turn, has the consequence of an increase of the temperature of the engine 1 via the combustions associated therewith. It is understood that in lieu of the integrated air mass mli, an integrated fuel mass and/or, in the simplest case, the engine temperature TM can be used.

The output values of the two characteristics fields (21, 22) are multiplicatively coupled to each other from which the load-dependent factor fLA arises. The load-dependent factor fLA is additively coupled to the base factor fG from which the warm-up factor fWL arises.

Furthermore, an rpm weighting fn of the warm-up enrichment of the engine 1 is determined via a characteristic line 23. In lieu of the characteristic line 23, a characteristic field can be provided which, in addition to the rpm-dependency, is also dependent upon a temperature or the relative air mass or the relative fuel mass.

As shown in FIG. 2 with a solid line, this rpm weighting fn can, on the one hand, operate via a multiplicative coupling directly on the load-dependent factor fLA. As an alternative, it is, on the other hand, possible that the rpm weighting fn operates first multiplicatively on the sum of the load-dependent factor fLA and the base factor fG as shown by the broken line in FIG. 2.

In addition, it is possible to provide a characteristic line or a characteristic field in a further branch of FIG. 2 which is dependent upon lambda and is coupled multiplicatively or additively to one of the other above-described branches.

The warm-up factor fWL is determined in a direct-injection engine 1 in the manner described above in dependence upon the operating mode of the engine 1. This means that the characteristic fields (30, 21, 22) or the characteristic line (23) of FIG. 2 are available for each of the operating modes of the engine 1, that is, especially for the stratified operation and the homogeneous operation.

If the engine 1 is switched over between the different operating modes during warm up, then a switchover takes place also with respect to the determination of the warm-up factor fWL. If the engine temperature TM approaches the operating temperature of the engine 1, then the warm-up factor fWL approaches one and its influence on the fuel quantity, which is to be injected, goes toward zero.

If the warm-up factor fWL, which is described with respect to FIG. 2 (departing from FIG. 1), is used with an engine having intake manifold injection, then the characteristic fields (30, 21, 22) and/or the characteristic line 23 of FIG. 2 are present only once and for the homogeneous operation. A switchover between operating modes does not take place.

What is claimed is:

1. A method for warming up a direct-injection internal combustion engine having an operating temperature including an internal combustion engine of a motor vehicle, the method comprising the steps of:

injecting fuel directly into a combustion chamber of said engine;

determining a warm-up factor (fWL) for increasing the quantity of the injected fuel at a temperature of said engine below said operating temperature from a base factor (fG) and a load-dependent factor (fLA) with said load-dependent factor (fLA) being determined for first and second modes of operation of said direct-injection internal combustion engine independently of said base factor (fG) with said first mode of operation being a stratified mode of operation wherein the fuel is injected directly into said combustion chamber during the compression phase and with said second mode of operation being a homogeneous mode of operation wherein the fuel is injected directly into the combustion chamber during the induction phase.

2. The method of claim 1, wherein the load-dependent factor (fLA) is determined in dependence upon an integrated air mass (mli) and/or an integrated fuel mass and/or an engine temperature (TM) of the engine.

3. The method of claim 1, wherein the load-dependent factor (fLA) is determined in dependence upon a relative air charge (rl) and/or a relative fuel quantity and/or an actual or desired lambda and/or an actual or desired torque of the engine.

4. The method of claim 3, wherein the load-dependent factor (fLA) is determined by a multiplicative coupling.

5. The method of claim 1, wherein the base factor (fG) is determined in dependence upon the engine temperature (TM).

6. The method of claim 1, wherein the load-dependent factor (fLA) and the base factor (fG) are coupled additively to each other.

7. The method of claim 1, wherein the load-dependent factor (fLA) or the sum of the load-dependent factor (fLA) and the base factor (fG) are weighted in dependence upon the rpm (n) of the engine.

8. The method of claim 1, wherein the load-dependent factor (fLA) and/or the base factor (fG) and/or the warm-up factor (fWL) are determined in dependence upon the engine start temperature (TMS).

9. A control element including a read-only-memory or flash memory for a control apparatus of a direct-injection internal combustion engine including an engine of a motor vehicle, said control element comprising a program stored thereon which is suitable to be run on a computing apparatus including a microprocessor, and said program being configured to carry out the method steps of:

injecting fuel directly into a combustion chamber of said engine;

determining a warm-up factor (fWL) for increasing the quantity of the injected fuel at a temperature of said engine below said operating temperature from a base factor (fG) and a load-dependent factor (fLA) with said load-dependent factor (fLA) being determined for first and second modes of operation of said direct-injection internal combustion engine independently of said base factor (fG) with said first mode of operation being a stratified mode of operation wherein the fuel is injected directly into said combustion chamber during the compression chase and with said second mode of operation being a homogeneous mode of operation wherein the fuel is injected directly into the combustion chamber during the induction phase.

10. An internal combustion engine having an operating temperature including a direct-injection internal combustion engine of a motor vehicle, the engine comprising:

means for injecting fuel directly into a combustion chamber of said engine during warm up of said engine;

a control apparatus for determining a warm-up factor (fWL) for increasing the injected quantity of fuel at a temperature of said engine below said operating temperature; and, said control apparatus including means for determining said warm-up factor (fWL) from a base factor (fG) and a load-dependent factor (fLA) with said load-dependent factor (fLA) being determinable for first and second operating modes of said direct-injection internal combustion engine independently of said base factor (fG) with said first mode of operation being a stratified mode of operation wherein the fuel is injected directly into said combustion chamber during the compression phase and with said second mode of operation being a homogeneous mode of operation wherein the fuel is injected directly into the combustion chamber during the induction phase.

11. A control apparatus for a direct-injection internal combustion engine having an operating temperature including an internal combustion engine of a motor vehicle, the control apparatus comprising:

means for controlling the injection of fuel into a combustion chamber of said engine during warm up of said engine;

means for determining a warm-up factor (fWL) for increasing the injected quantity of fuel at a temperature of said engine below said operating temperature; and, said control apparatus including means for determining said warm-up factor from a base factor (fG) and a load-dependent factor (fLA) with said load-dependent factor (fLA) being determinable for first and second operating modes of said direct-injection internal combustion engine independently of said base factor (fG) with said first mode of operation being a stratified mode of operation wherein the fuel is injected directly into said combustion chamber during the compression phase and with said second mode of operation being a homogeneous mode of operation wherein the fuel is injected directly into the combustion chamber during the induction phase.

* * * * *